US006597267B2

(12) United States Patent
Bauer et al.

(10) Patent No.: US 6,597,267 B2
(45) Date of Patent: Jul. 22, 2003

(54) ELECTROMAGNETIC SWITCHING DEVICE, FOR EXAMPLE, CONTACTOR

(75) Inventors: Johann Bauer, Ebermannsdorf (DE); Stephan Faber, Kuemmersbruck (DE); Bardo Koppmann, Kaltenbrunn (DE); Manuela Lueftl, Amberg (DE); Markus Meier, Rieden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/220,198

(22) PCT Filed: Feb. 20, 2001

(86) PCT No.: PCT/DE01/00634

§ 371 (c)(1),
(2), (4) Date: Aug. 29, 2002

(87) PCT Pub. No.: WO01/65579

PCT Pub. Date: Sep. 7, 2001

(65) Prior Publication Data

US 2003/0020575 A1 Jan. 30, 2003

(30) Foreign Application Priority Data

Feb. 29, 2000 (DE) ..... 100 09 496

(51) Int. Cl.[7] ..... H01H 50/04
(52) U.S. Cl. ..... 335/132; 335/202
(58) Field of Search ..... 335/131, 132, 335/202

(56) References Cited

U.S. PATENT DOCUMENTS

| | | | | |
|---|---|---|---|---|
| 4,253,076 A | 2/1981 | Guery et al. | ..... | 335/132 |
| 4,506,243 A | 3/1985 | Okado et al. | ..... | 335/132 |

FOREIGN PATENT DOCUMENTS

| | | |
|---|---|---|
| DE | 2620210 | 11/1977 |
| DE | 2901552 | 7/1979 |
| DE | 3220040 | 4/1983 |
| DE | 4236900 | 5/1994 |
| FR | 2415359 | 1/1978 |
| GB | 2102628 | 5/1982 |
| WO | 95/12891 | 5/1995 |

*Primary Examiner*—Ramon M. Barrera
(74) *Attorney, Agent, or Firm*—Harness, Dickey & Pierce, P.L.C.

(57) ABSTRACT

An electromagnetic switching device includes a housing and a plug-in module which can be inserted into the housing at an insertion point in a direction of insertion. The plug-in module holds a magnetic yoke, attached to which is a coil unit. Two extensions, which point respectively to the front and to the rear in relation to the direction of insertion, are formed on the magnetic yoke. In order to retain the magnetic yoke, a retaining bracket extending transversally in relation to the direction of insertion, overlaps one of the fixing extensions and engages two retaining tongues from below, said tongues being formed as one-piece with the plug-in module.

30 Claims, 8 Drawing Sheets

ELECTROMAGNETIC SWITCHING DEVICE, FOR EXAMPLE, CONTACTOR

This application is the national phase under 35 U.S.C. §371 of PCT International Application No. PCT/DE01/00634 which has an International filing date of Feb. 20, 2001, which designated the United States of America, and which claims priority on patent application Ser. No. 100 09 496.1 filed Feb. 29, 2000, the entire contents of which are hereby incorporated by reference.

FIELD OF THE INVENTION

The present invention generally relates to an electromagnetic switching device, for example a contactor. Preferably, it relates to one having a switching device enclosure and having a detachable unit which can be inserted into the switching device enclosure at an insertion point. More preferably:

- the detachable unit holds a magnet yoke to which a coil unit is fitted, by which a pull-in force can be exerted on an armature,
- two fastening attachments are included, which respectively point forward and to the rear seen in the insertion direction, being integrally formed on the magnet yoke.

BACKGROUND OF THE INVENTION

A switching device is known, for example, from WO 95/12891. In this document, the fastening attachments have through-holes, in which latching hooks engage which are integrally formed on the detachable unit.

Further electromagnetic switching devices having a switching device enclosure and having a detachable unit which can be inserted into the switching device enclosure are known, for example, from DE 29 01 552 C2 and from DE 32 20 040 C2.

DE 26 20 210 A1 discloses an electromagnetic switching device in which an E-shaped magnet yoke has fastening attachments, which point outward and can be inserted into attachment receptacles in the switching device enclosure, on its outer limbs. A similar disclosure content can be found in DE 42 36 900 A1.

The detachable units according to the prior art are all relatively complicated, with a comparatively large number of parts. They thus have a relatively high magnet movement tolerance.

SUMMARY OF THE INVENTION

An object of an embodiment of the present invention is to provide an electromagnetic switching device having a switching device enclosure and having a detachable unit which can be inserted into the switching device enclosure. Preferably, the switching device and/or the detachable unit have a simpler design but nevertheless operates reliably, while the magnet movement tolerance of the magnet system remains small.

An object may be achieved in that a holding bracket, which extends transversely with respect to the insertion direction, may engage over one of the fastening attachments in order to hold the magnet yoke. Further, it may engage under two holding tongues, which are integrally formed on the detachable unit.

In comparison to WO 95/12891, this results in the magnet yoke being held better and in a simpler fashion, while in comparison to DE 29 01 552 C2 and DE 32 20 040 C2, it results in a considerable saving in individual parts.

If the switching device enclosure has a holding bracket contour on which the holding bracket is supported—directly or via the holding tongues—when the detachable unit is inserted, the holding tongues have to be able to withstand only the natural weight of the magnet yoke, but not forces which occur during operation of the switching device.

If the holding tongues are elastically connected to the detachable unit, this results in the magnet yoke being fastened in a particularly simple and reliable manner.

The other fastening attachment can in principle likewise be connected to the detachable unit via a holding bracket and holding tongues. However, a physically simpler design is achieved if the other fastening attachment is inserted into an attachment receptacle. The attachment receptacle is in this case preferably integrally formed on the detachable unit. If the attachment receptacle is arranged in front of the holding bracket, seen in the insertion direction, this results in the detachable unit design being physically even simpler.

If the attachment receptacle is designed to be elastic in height, this results in the magnet yoke being held in a clamped manner. If the switching device enclosure has a receptacle contour on which the attachment receptacle is supported when the detachable unit is inserted, the attachment receptacle also has to be able to withstand only the natural weight of the magnet yoke.

If the attachment receptacle and the receptacle contour first of all interact via an insertion incline during insertion of the detachable unit, this allows the detachable unit to be inserted into the switching device enclosure without any snagging and without being subject to tolerances.

If a latching hook for latching the detachable unit in the switching device enclosure and an operating element for the latching hook are integrally formed in a sprung manner on the detachable unit, no separate latching hook is required for latching. A bar spring preferably engages over the latching hook and/or the operating element in order to provide force assistance.

If the coil unit has a coil and a contact foot which is connected to the coil via an intermediate structure, rests on a foot contact on the detachable unit at the side underneath the coil and is at a distance from the coil, this results in the coil unit being supported robustly, in a simple manner.

If the foot contact is arranged recessed in the detachable unit, such that the contact foot is recessed in the detachable unit, this results in the detachable unit having a small physical height. If the switching device enclosure has a coil contour on which the coil unit is supported when the detachable unit is inserted, there is no need for the operating forces to be absorbed by the detachable unit. The coil unit can be supported on the coil contour via the contact foot, for example.

If the coil unit is braced by the coil contour and the detachable unit, the coil is fixed in the switching device enclosure without any play. It can thus not oscillate freely.

If the coil unit has a switch which can be operated by the armature via an operating element, the operating element is mounted in a bearing which is arranged on the coil unit and the switching device enclosure has positioning and supporting elements, by which the bearing can be positioned during insertion of the detachable unit and is supported when the detachable unit is inserted, the operating element can be aligned exactly with respect to the armature in a simple manner.

If the switching device enclosure has a recess on a side opposite the insertion point, via which recess the detachable unit can be driven out of the switching device enclosure by means of a driving-out tool, the detachable unit can be disconnected from the switching device even in the event of a defect in a comparatively simple manner, namely in particular without complete disassembly of the switching device.

BRIEF DESCRIPTION OF THE DRAWINGS

Further advantages and details can be found in the following description of an exemplary embodiment. In this case, illustrated in outline form.

DETAILED DESCRIPTION OF THE PREFERRED EMBODIMENTS

Figure 1:
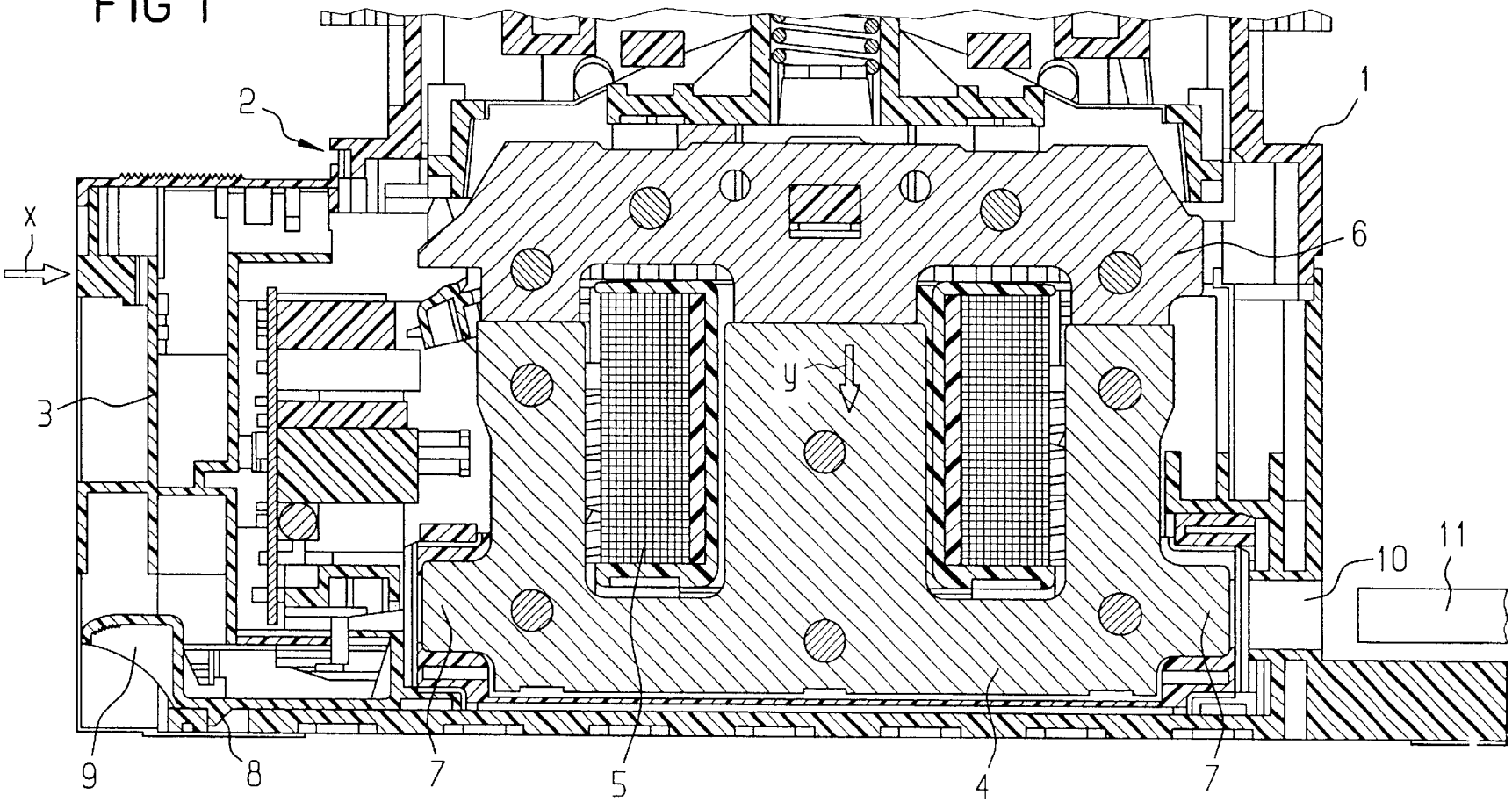
FIG. 1 shows a section through a contactor with a detachable unit.
Figure 8:
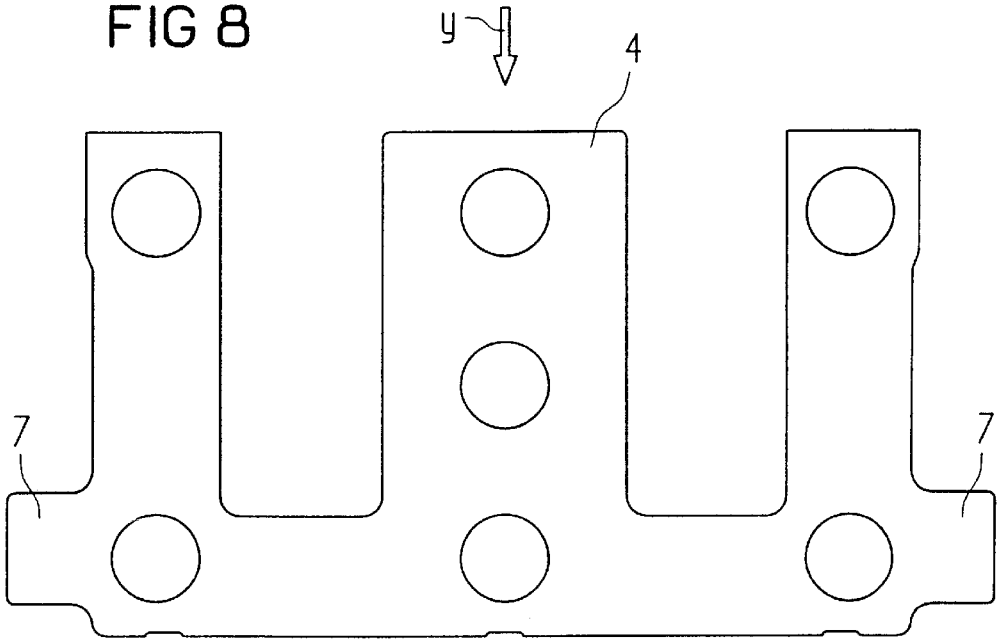
FIG. 8 shows a magnet yoke.
Figure 9:
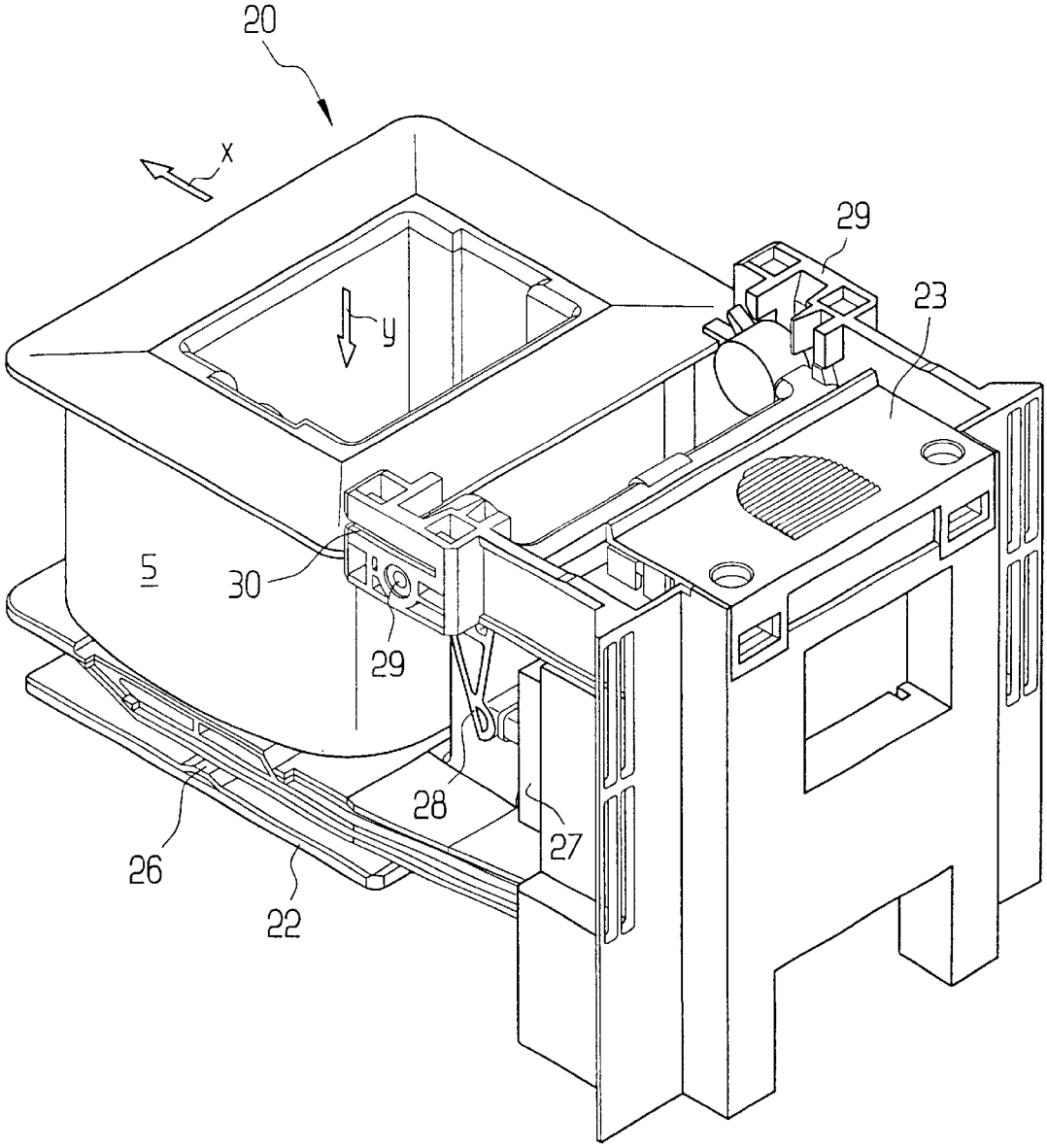
FIG. 9 shows a coil unit.

As shown in FIG. 1, a contactor, as an example of an electromagnetic switching device, has a switching device enclosure 1. A detachable unit 3, such as a plug-in module for example, can be inserted into the switching device enclosure 1 in an insertion direction x at an insertion point 2. The detachable unit 3 holds a magnet yoke 4. The magnet yoke 4 and a coil 5 allow a pull-in force to be exerted on an armature 6 in a force direction y. As shown in FIGS. 1 and 8, two fastening attachments or extensions 7 are integrally formed on the magnet yoke 4. The fastening attachments 7 respectively point forward and to the rear, viewed in the insertion direction x.

As shown in FIG. 1, the detachable unit 3 has a latching hook 8, which is provided with an operating element 9. The detachable unit 3 can be latched in the switching device enclosure 1 via the latching hook 8. The latching hook 8 and the operating element 9 are integrally formed on the detachable unit 3 in a sprung manner. In order to withdraw the detachable unit 3 from the switching device enclosure 1, the operating element 9 is just raised, and the detachable unit 3 is withdrawn from the switching device enclosure 1 using the operating element 9.

For a situation where the detachable unit 3 cannot be withdrawn owing to a defect, the switching device enclosure 1 has a recess 10. As can be seen, the recess 10 is arranged on a side of the switching device enclosure 1 which is opposite the insertion point 2. A schematically illustrated driving-out tool 11, for example a punch, can be attached to the front fastening attachment 7 of the magnet yoke 4 via the recess 10, so that the detachable unit 3 can be driven out of the switching device enclosure 1 using a hammer.

Figure 5:
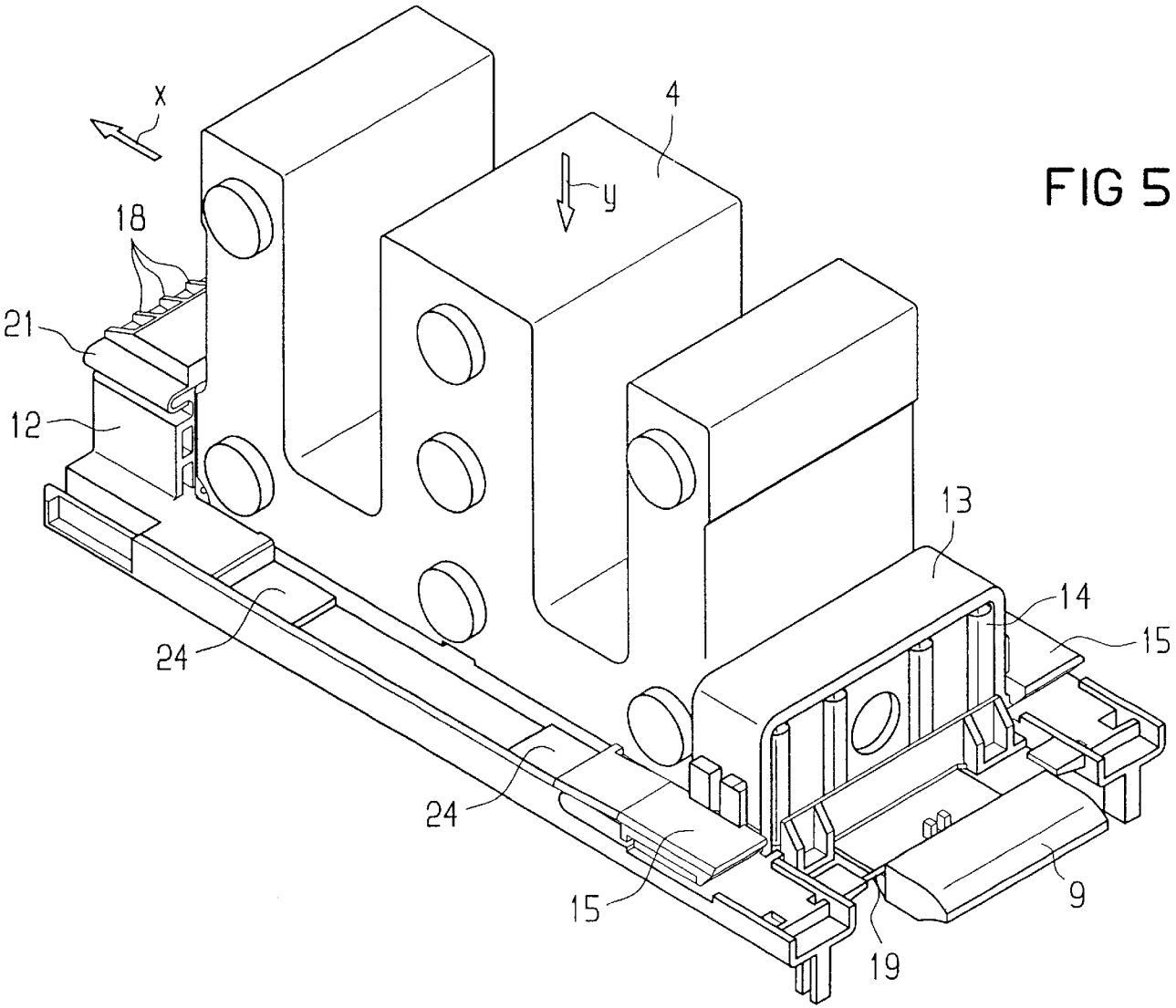
FIG. 5 shows the detachable unit from FIG. 4 without a coil unit.
Figure 7:
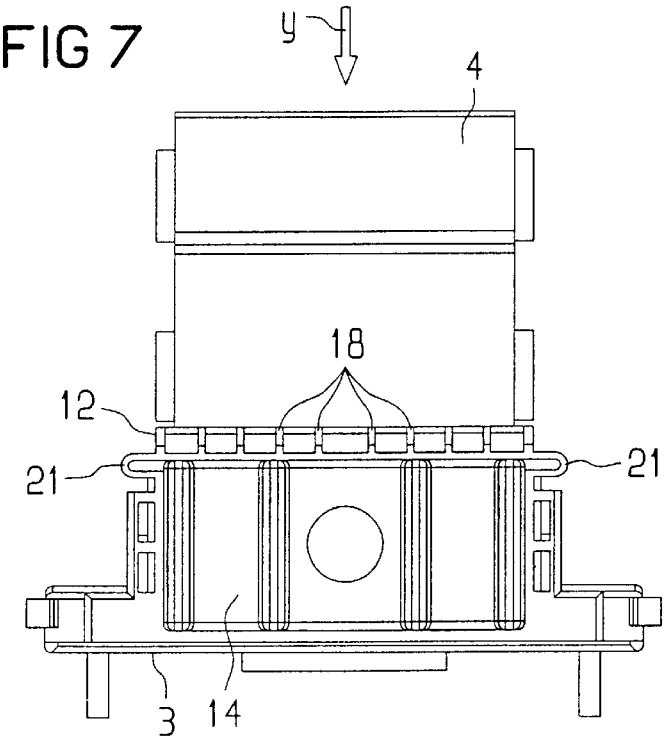
FIG. 7 shows the detachable unit from FIG. 5 from the front.

As shown in FIG. 5, the magnet yoke 4 is held by an attachment receptacle 12 and holding bracket 13. The attachment receptacle 12 is arranged in front of the holding bracket 13, seen in the insertion direction x. It is integrally formed on the detachable unit 3. As shown in FIGS. 5 and 7, the attachment receptacle 12 has U-shaped expansion elements 21. It is thus designed such that it is elastic in height.

Damping parts 14, for example composed of rubber, are fitted to the fastening attachments 7 in order to attach the magnet yoke 4 to the detachable unit 3. One of the fastening attachments 7 is then inserted into the attachment receptacle 12.

The holding bracket 13 extends essentially transversely with respect to the insertion direction x over the other fastening attachment 7. It engages over this fastening attachment 7. Furthermore, the holding bracket 13 engages under two holding tongues 15, which are integrally formed in an elastic manner on the detachable unit 3.

Figure 2:
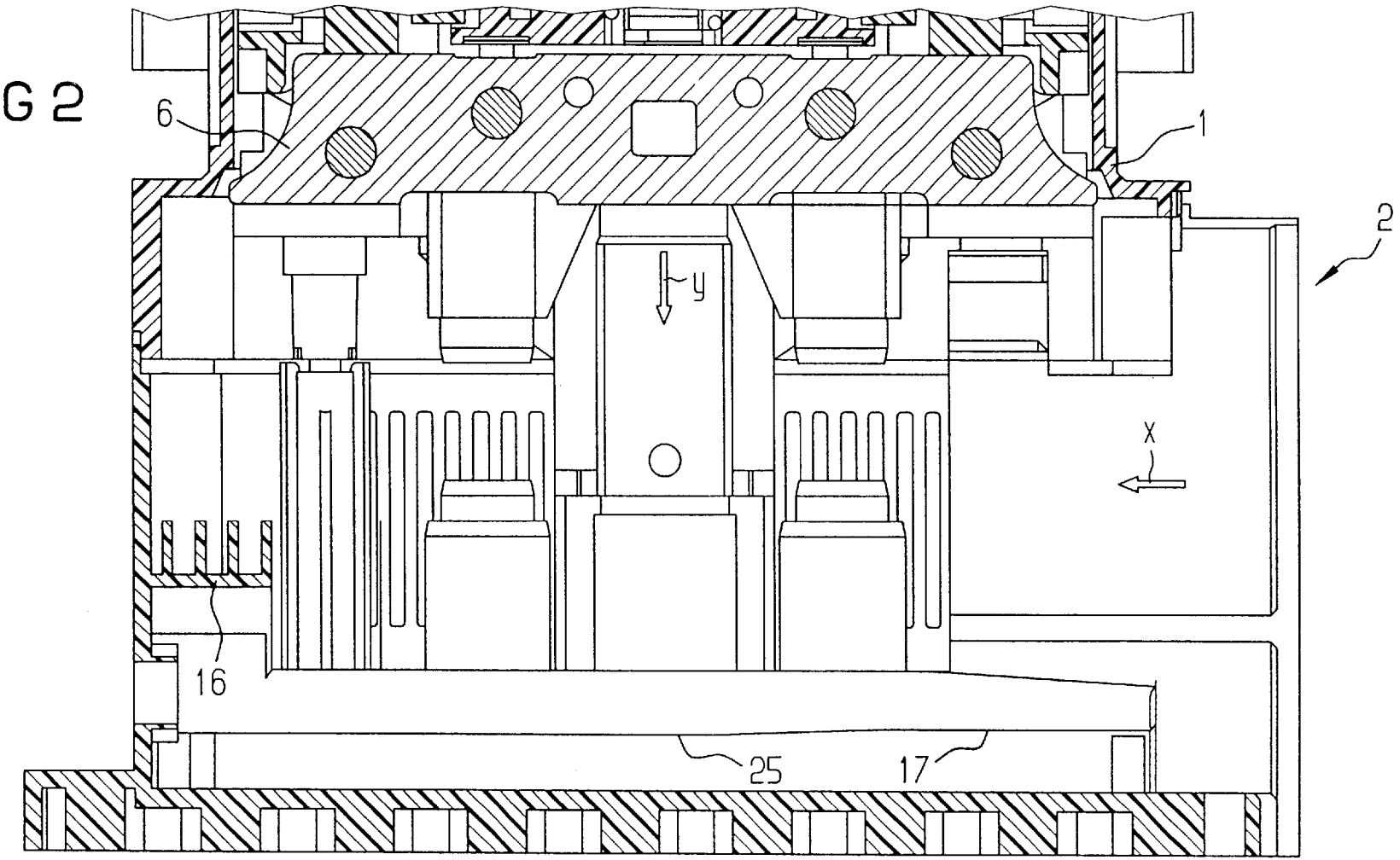
FIG. 2 shows the contactor from FIG. 1 without the detachable unit.
Figure 3:
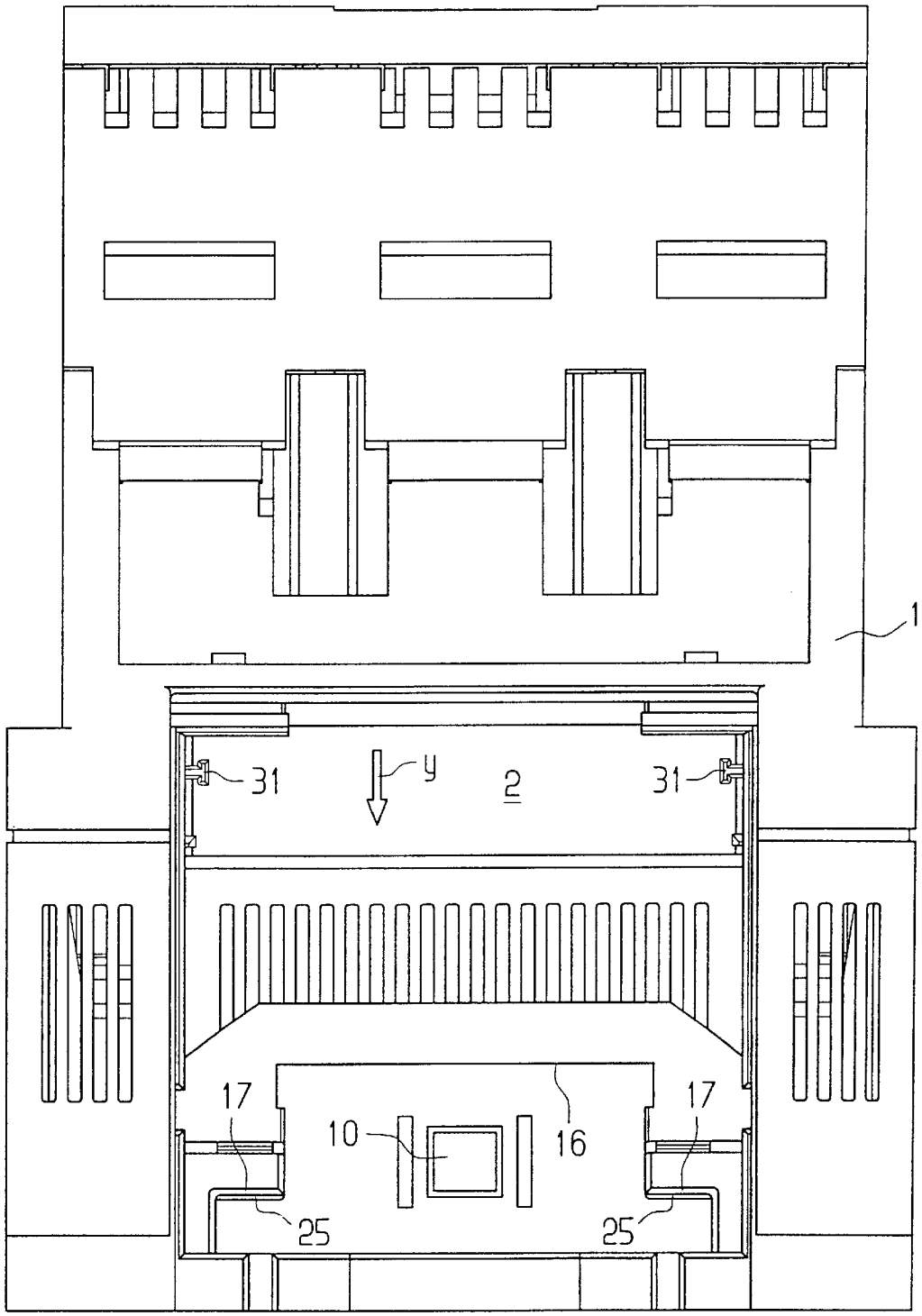
FIG. 3 shows the contactor from FIG. 2 from the front.

As shown in FIG. 2, the switching device enclosure 1 has a receptacle contour 16 and a holding bracket contour 17. When the detachable unit 3 is inserted in the switching device enclosure 1, the attachment receptacle 12 is supported on the receptacle contour 16, and the holding bracket 13 is supported on the holding bracket contour 17. According to the exemplary embodiment, the holding bracket 13 is in this case supported on the holding bracket contour 17 via the holding tongues 15. If the holding bracket 13 is sufficiently wide, it could, however, also be supported directly on the holding bracket contour 17. The supports mean that the magnetic forces which occur during switching of the contactor are introduced directly into the switching device enclosure 1, rather than into the detachable unit 3.

The attachment receptacle 12 and the receptacle contour 16 first of all interact via an insertion incline 18 during insertion of the detachable unit 3, which insertion incline 18 is arranged, according to the exemplary embodiment, on the attachment receptacle 12. This makes it considerably easier to insert the detachable unit 3 into the switching device enclosure 1.

Figure 6:
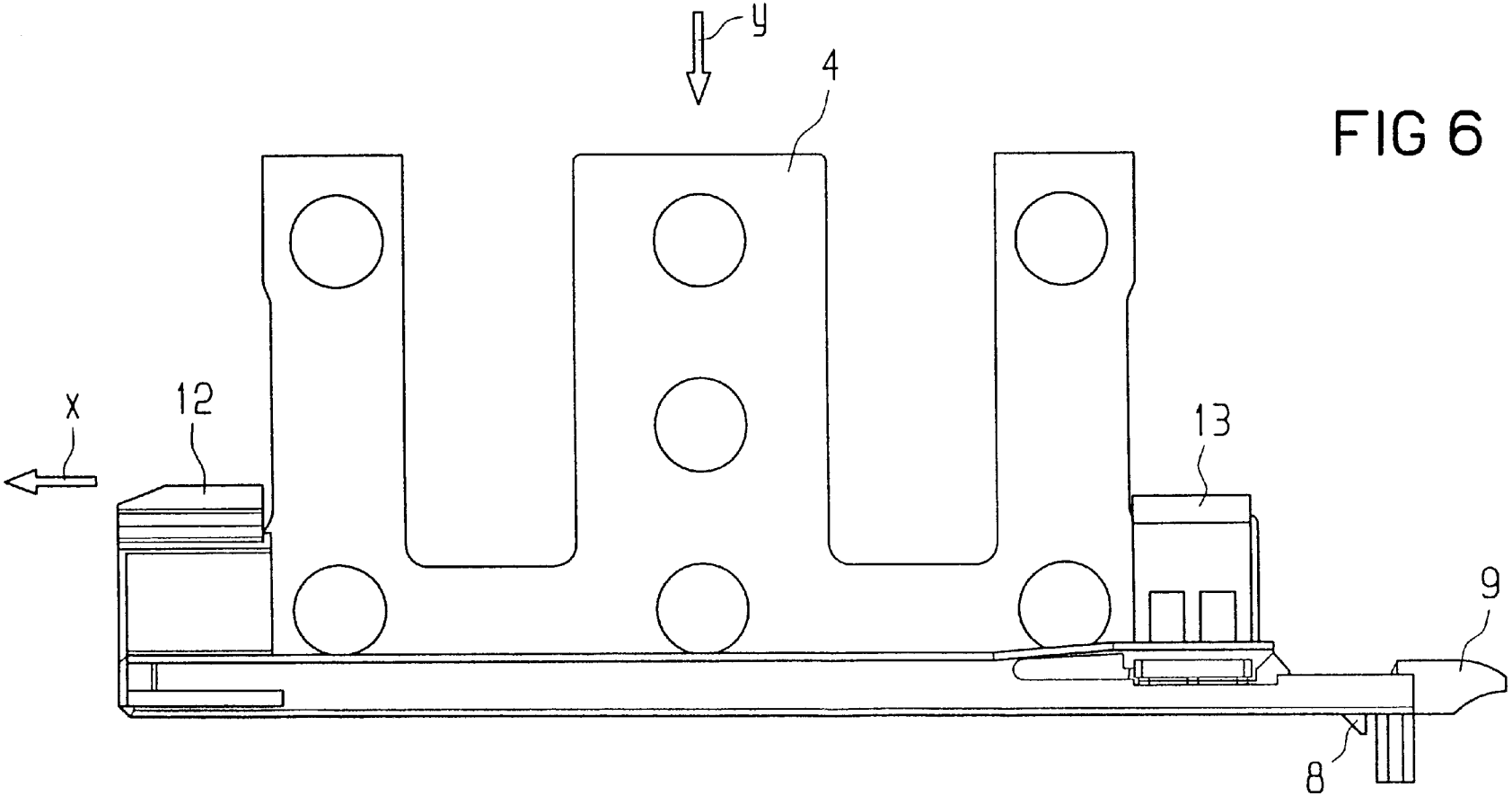
FIG. 6 shows the detachable unit from FIG. 5 from the side.

The insertion incline 18 can be seen particularly clearly in FIGS. 5 and 6. It can also be seen from FIG. 5 that a bar spring 19 engages over the latching hook 8 and its operating element 9, in order to provide force assistance.

Figure 4:
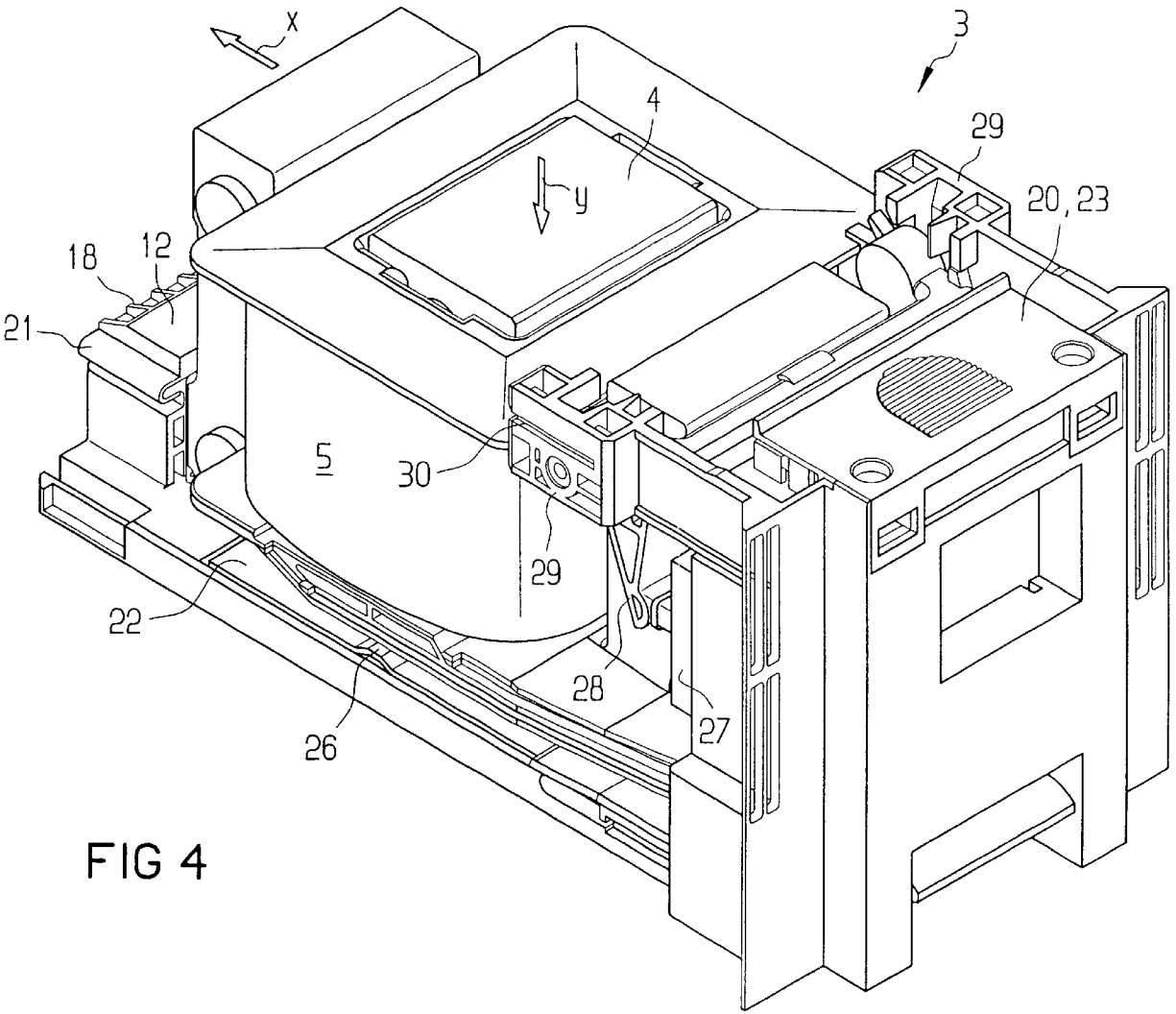
FIG. 4 shows a detachable unit with a magnet yoke and a coil unit.

As shown in FIG. 4, a coil unit 20 is fitted to the magnet yoke 4. In addition to the coil 5, the coil unit 20 also has a contact foot 22. The contact foot 22 is connected to the coil 5 via an intermediate structure 23. The contact foot 22 is arranged at the side underneath the coil 5 and, as can be seen, is at a distance from the coil 5. It rests on a foot contact 24 on the detachable unit 3. The foot contact 24 is arranged recessed in the detachable unit 3, so that the contact foot 22 is recessed in the detachable unit 3.

As shown in FIG. 2, the switching device enclosure 1 has a coil contour 25, on which the coil unit 20 is supported when the detachable unit 3 is inserted. In this case, the coil unit 20 is supported on the coil contour 25 via the contact foot 22. As can be seen, the coil unit 20 is in this case braced by the coil contour 25 by means of a projection 26, which is arranged on the contact foot 22.

The coil unit 20 has a switch 27, which can be operated by the armature 6 via an operating element 28. The operating element 28 is mounted in a bearing 29, which is arranged on the coil unit 20. Grooves 30 with a T-shaped cross section are arranged on the outsides of the bearing 29 and, during insertion of the detachable unit 3, interact with positioning and supporting elements 31, which likewise have a T-shaped cross section. The interaction of the grooves 30 with the positioning and supporting elements 31 results in the bearing 29 being positioned during insertion of the detachable unit 3, and being supported when the detachable unit 3 is inserted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electromagnetic switching device, comprising:

a switching device enclosure; and a detachable unit, insertable into the switching device enclosure in an insertion direction at an insertion point, the detachable unit holding a magnet yoke to which a coil unit is fitted, by which a pull-in force is exertable on an armature, the detachable unit including, two fastening attachments, respectively pointing forward and to the rear viewed in the insertion direction, wherein the attachments are integrally formed on the magnet yoke, and a holding bracket, extending transversely with respect to the insertion direction, engaging over one of the fastening attachments in order to hold the magnet yoke, and engaging under two holding tongues, which are integrally formed on the detachable unit.

2. The switching device as claimed in claim 1, wherein the switching device enclosure includes a holding bracket contour on which the holding bracket is supported when the detachable unit is inserted.

3. The switching device as claimed in claim 2, wherein the holding bracket is supported at least one of directly and via the holding tongues.

4. The switching device as claimed in claim 2, wherein the holding tongues are elastically connected to the detachable unit.

5. The switching device as claimed in claim 2, wherein the other fastening attachment is inserted into an attachment receptacle.

6. The switching device as claimed in claim 1, wherein the holding tongues are elastically connected to the detachable unit.

7. The switching device as claimed in claim 1, wherein the other fastening attachment is inserted into an attachment receptacle.

8. The switching device as claimed in claim 7, wherein in the attachment receptacle is integrally formed on the detachable unit.

9. The switching device as claimed in claim 8, wherein the attachment receptacle is arranged in front of the holding bracket, viewed in the insertion direction.

10. The switching device as claimed in claim 8, wherein the attachment receptacle is designed to be elastic in height.

11. The switching device as claimed in claim 7, wherein the attachment receptacle is arranged in front of the holding bracket, viewed in the insertion direction.

12. The switching device as claimed in claim 11, wherein the attachment receptacle is designed to be elastic in height.

13. The switching device as claimed in claim 7, wherein the attachment receptacle is designed to be elastic in height.

14. The switching device as claimed in claim 7, wherein the switching device enclosure has a receptacle contour on which the attachment receptacle is supported when the detachable unit is inserted.

15. The switching device as claimed in claim 14, wherein the attachment receptacle and the receptacle contour first of all interact via an insertion incline during insertion of the detachable unit.

16. The switching device as claimed in claim 1, wherein a latching hook for latching the detachable unit in the switching device enclosure, and a operating element for the latching hook, are integrally formed in a sprung manner on the detachable unit.

17. The switching device as claimed in claim 16, wherein a bar spring engages over at least one of the latching hook and the operating element in order to provide force assistance.

18. The switching device as claimed in claim 1, wherein the coil unit has a coil and a contact foot, which is connected to the coil via an intermediate structure, and wherein the contact foot rests on a foot contact on the detachable unit at the side underneath the coil, and is at a distance from the coil.

19. The switching device as claimed in claim 18, wherein the foot contact is arranged recessed in the detachable unit, such that the contact foot is recessed in the detachable unit.

20. The switching device as claimed in claim 19, wherein the coil unit is supported on the coil contour via the contact foot.

21. The switching device as claimed in claim 18, wherein the coil unit is supported on the coil contour via the contact foot.

22. The switching device as claimed in claim 21, wherein the coil unit is braced by the coil contour.

23. The switching device as claimed in claim 1, wherein the switching device enclosure has a coil contour on which the coil unit is supported when the detachable unit is inserted.

24. The switching device as claimed in claim 23, wherein the coil unit is braced by the coil contour.

25. The switching device as claimed in claim 23, wherein the coil unit is supported on the coil contour via the contact foot.

26. The switching device as claimed in claim 1, wherein the coil unit has a switch, which can be operated by the armature via an operating element, wherein the operating element is mounted in a bearing which is arranged on the coil unit, and wherein the switching device enclosure has positioning and supporting elements, via which the bearing can be positioned during insertion of the detachable unit, and is supported when the detachable unit is inserted.

27. The switching device as claimed in claim 1, wherein the switching device enclosure has a recess on a side opposite the insertion point, via which recess the detachable unit can be driven out of the switching device enclosure via a driving-out tool.

28. The switching device of claim 1, wherein the switching device is a contactor.

29. A switching device comprising:

a housing; and a plug-in module, insertable into the housing in a direction of insertion, wherein the plug-in module holds a magnetic yoke, attached to which is a coil unit, a plurality of extensions, which point respectively to the front and to the rear in relation to the direction of insertion, are formed on the magnetic yoke, and in order to retain the magnetic yoke, a retaining bracket extending transversally in relation to the direction of insertion, overlaps one of the extensions and engages a plurality of retaining tongues from below, said tongues being integrally formed with the plug-in module.

30. The switching device as claimed in claim 29, wherein the holding tongues are elastically connected to the plug-in module.

* * * * *